US007255203B2

(12) United States Patent
Rennetaud et al.

(10) Patent No.: US 7,255,203 B2
(45) Date of Patent: Aug. 14, 2007

(54) CLUTCH FOR COUPLING A CAR DOOR OF AN ELEVATOR CAR WITH A LANDING DOOR OF AN ELEVATOR SYSTEM

(75) Inventors: Jean-Marie Rennetaud, Valley Gardens, IL (US); Tian Zhou, Reussbühl (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/962,645

(22) Filed: Oct. 12, 2004

(65) Prior Publication Data

US 2005/0126860 A1 Jun. 16, 2005

(30) Foreign Application Priority Data

Oct. 14, 2003 (EP) ..... 03405737

(51) Int. Cl.
*B66B 13/02* (2006.01)

(52) U.S. Cl. ..... 187/321; 187/319; 187/326; 187/330; 187/334; 187/341; 49/120

(58) Field of Classification Search ..... 187/315, 187/317, 319, 320–25, 330–334; 49/31, 49/71.3, 116–120, 136; 414/592, 659; 254/128, 254/141.5, 471, 479; 52/30; 318/687; *B66B 13/14, B66B 13/06, 13/24*
See application file for complete search history.

(56) References Cited

U.S. PATENT DOCUMENTS 1,326,440 A * 12/1919 Chaudoir ..... 187/330
2,481,124 A * 9/1949 Kruger ..... 187/319
3,738,454 A 6/1973 Atkey
3,891,907 A * 6/1975 Lenzkes et al. ..... 318/369
4,015,688 A 4/1977 Mangel
4,926,975 A 5/1990 Morris
5,575,357 A * 11/1996 Spiess ..... 187/319
5,736,693 A * 4/1998 Piech et al. ..... 187/316
6,173,815 B1 * 1/2001 Mittermayr ..... 187/330
6,189,658 B1 * 2/2001 Karner ..... 187/319
6,659,514 B2 * 12/2003 Bass ..... 292/122
2003/0037996 A1 * 2/2003 Yamamoto et al. ..... 187/316

FOREIGN PATENT DOCUMENTS

| | | |
|---|---|---|
| EP | 0 676 360 | 10/1995 |
| EP | 0 841 288 | 5/1998 |
| FR | 2827266 | 1/2003 |

* cited by examiner

*Primary Examiner*—Gene O. Crawford
*Assistant Examiner*—Stefan Kruer
(74) *Attorney, Agent, or Firm*—Fraser Clemens; William J. Clemens

(57) ABSTRACT

A clutch couples a car door of an elevator car with a landing door of an elevator system, wherein the car door is movable with respect to the elevator car by a first actuator. The clutch includes at least one coupling element and a second actuator. The coupling element is movable with respect to the car door between a first position and a second position by the second actuator such that the coupling element engages with the landing door when the elevator car is within a landing zone and the coupling element is moved towards the second position, thereby establishing the coupling of the car door with the landing door. The second actuator is a linear motor.

10 Claims, 4 Drawing Sheets

CLUTCH FOR COUPLING A CAR DOOR OF AN ELEVATOR CAR WITH A LANDING DOOR OF AN ELEVATOR SYSTEM

BACKGROUND OF THE INVENTION

The present invention is related to a clutch for coupling a car door of an elevator car with a landing door of an elevator system.

A conventional elevator system comprises two different sets of doors, i.e. car doors and landing doors. In general, each car of the elevator system includes at least one car door. Within each landing zone of the elevator system, at least one landing door is installed. Each landing door is located such that, when the car is stopped within the corresponding landing zone, the landing door is adjacent to a car door so that the interior of the elevator is accessible through the landing door and the car door provided that both doors are open. Under normal conditions, the landing doors are kept closed whenever the car is not present in the related landing zones. Instead of having actuators for each of the landing doors, a particular landing door can be coupled with the car door by means of a clutch that is arranged at the car door. If access to the elevator car through a particular landing door and a particular car door is desired, the elevator car is moved into the landing zone corresponding to that landing door and stopped. In addition, the car door is mechanically coupled with the landing door by means of the clutch when the car enters the landing zone. Afterwards, the landing door and the car door can be opened or closed by means of an actuator that is linked to the car door. Prior to moving the car to another landing door, the clutch is released, thereby uncoupling the car door and the landing door.

In general, the clutch is arranged at the car door and comprises at least one coupling element, which is movable with respect to the car door between a first position and a second position such that the coupling element engages with the landing door, when the elevator car is within a landing zone and the coupling element is moved towards the second position, thereby establishing the coupling of the car door with the landing door. For uncoupling the car door and the landing door, the coupling element is moved towards the first position.

For actuating the clutch, two different concepts are known. In a first concept, the clutch is linked to the actuator which drives the car door. Thus, the coupling element of the clutch and the car door are simultaneously driven by means of a single actuator. In a second concept, two actuators are provided, one of said actuators being dedicated for driving the clutch and the other actuator being dedicated for driving the car door. The latter concept is advantageous in that it allows more freedom in the timing and synchronization of movement of the coupling element since the actuation of the clutch is independent of the actuator that drives the car door.

In European patent document EP 0 676 360 A1, a clutch for coupling a car door of an elevator car with a landing door of an elevator system is disclosed. The car door is movable with respect to the elevator car by means of a first actuator. The clutch comprises a coupling element and a second actuator. The coupling element is movable with respect to the car door between a first position and a second position by means of a second actuator such that the coupling element engages with the landing door, when the elevator car is within a landing zone and the coupling element is moved towards the second position, thereby establishing the coupling of the car door with the landing door. In particular, the coupling element consists of two vanes that are connected by means of a movable linkage. By means of the second actuator, the vanes are movable with respect to each other for establishing a mechanical contact of the vanes with rollers, which rotate about horizontal axles disposed at the top of the landing door, and which provide rotationally stiff coupling. As the second actuator, a solenoid acting on an armature against the bias of a spring is used. The armature is arranged in parallel with respect to the vanes and in a sliding contact with one of the vanes. By activating the solenoid, the armature can be moved, thereby causing a movement of the vanes perpendicular to the direction of movement of the armature so that the distance between the vanes is changed. In order to control the movement of the vanes, a bias is applied on the vanes by means of a compressed spring being connected with both vanes. This clutch has several disadvantages. The sliding contact between the armature and one of the vanes is subjected to wear, thus limiting the lifetime and the reliability of operation of the clutch. In addition, the actual position of the vanes is influenced by the balance of at least four forces, i.e. the forces being provided by the solenoid and two springs and the friction between the armature and one of the vanes. Thus, it is difficult to control the motion of the vanes precisely and to ensure a given accuracy of control over a long time. In addition, due to the bias of the springs, the operation of the second actuator is not very efficient since the force generated by means of the solenoid must compensate the spring forces.

In French patent document FR 2827266, a clutch for coupling a car door of an elevator car with a landing door of an elevator system is disclosed, the clutch being independently driven by means of a DC motor whereas the car door is opened or closed by means of a separate actuator. The force provided by the DC motor is transmitted to movable parts of the clutch by means of a gear or a screw drive. Due to friction in the gear or in the screw drive, a major part of the energy provided by the DC motor is lost. Thus, the efficiency of the clutch is reduced. Furthermore, if electric power is not available for driving the DC motor, it is difficult to operate the gear or the screw drive and, thus, it becomes difficult to actuate any component of the clutch. This is disadvantageous during the installation of the clutch in the elevator system. In the case of a power failure during operation of the elevator system, it may be necessary to manually operate the clutch. It is difficult or even impossible to exercise this task, depending on the friction in the gear or the screw drive.

SUMMARY OF THE INVENTION

In view of the disadvantages of known clutches, it is the objective of the present invention to provide a clutch which can be independently actuated by means of a separate actuator with high efficiency and with high precision.

The clutch is designed for coupling a car door of an elevator car with a landing door of an elevator system, wherein the car door is movable with respect to the elevator car by means of a first actuator. The clutch comprises at least one coupling element and a second actuator. The coupling element is movable with respect to the car door between a first position and a second position by means of the second actuator such that the coupling element engages with the landing door, when the elevator car is within a landing zone and the coupling element is moved towards the second position, thereby establishing the coupling of the car door with the landing door.

According to the present invention, the second actuator is a linear motor.

In this context, the term "linear motor" designates any motor comprising a motor primary and a motor secondary, wherein the motor primary and/or the motor secondary are movable in one dimension with respect to each other under the influence of a traveling magnetic field provided by the motor primary and acting on the motor secondary.

The use of a linear motor in accordance with the present invention has several advantages.

Linear motors usually provide a high force density since the distance between the motor primary and the motor secondary primary can be kept small. Therefore, optimized linear motors provide a high efficiency. In addition, in the clutch in accordance with the invention, the coupling element can be directly coupled with the linear motor. Thus, the coupling element of the clutch can be directly actuated by means of the linear motor. Consequently, components such as a gear or a screw drive are not necessary for coupling the linear motor with the coupling element. Thus, the coupling element can be actuated with low friction. Therefore, the clutch in accordance with the invention can be efficiently actuated. In addition, the second actuator does not require much space.

The position and the motion of the movable parts of a linear motor and the force provided by the linear motor can be precisely controlled on the basis of known technologies. Therefore, any movement of the coupling element of the clutch in accordance with the invention can be controlled with high precision. On this basis, the clutch can be operated with high reliability and with low noise.

If electric power is not supplied, the motor primary and the motor secondary of the linear motor can be easily moved with respect to each other with low friction, for example by hand. This makes it easier to install the motor during the assembly of the clutch and simplifies manual operation of the clutch during power failure.

In one embodiment of the present invention, the motor primary is arranged at the car door and the motor secondary is arranged for force transmission to the coupling element. Alternatively, the motor secondary may be arranged at the car door and the motor primary may be arranged for force transmission to the coupling element.

In another embodiment of the present invention, the motor secondary is linked to the coupling element by means of a first pivot and the motor primary is rotatable about a second pivot being stationary with respect to the car door. Alternatively, the motor primary may be linked to the coupling element by means of a first pivot and the motor secondary may be rotatable about a second pivot being stationary with respect to the car door. In particular, the coupling element may comprise two vanes that are connected by means of a movable linkage such that the vanes are movable with respect to each other for establishing a mechanical contact of the vanes with the landing door. In each case, the first pivot may be arranged at the linkage or at one of the vanes. On this basis, it is possible to establish a connection between the linear motor and the coupling element, which connection is resistant to wear and, therefore, long-lived.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

In FIGS. 1-5, a clutch 10 for coupling a car door of an elevator car with a landing door of an elevator system is shown.

Figure 1:
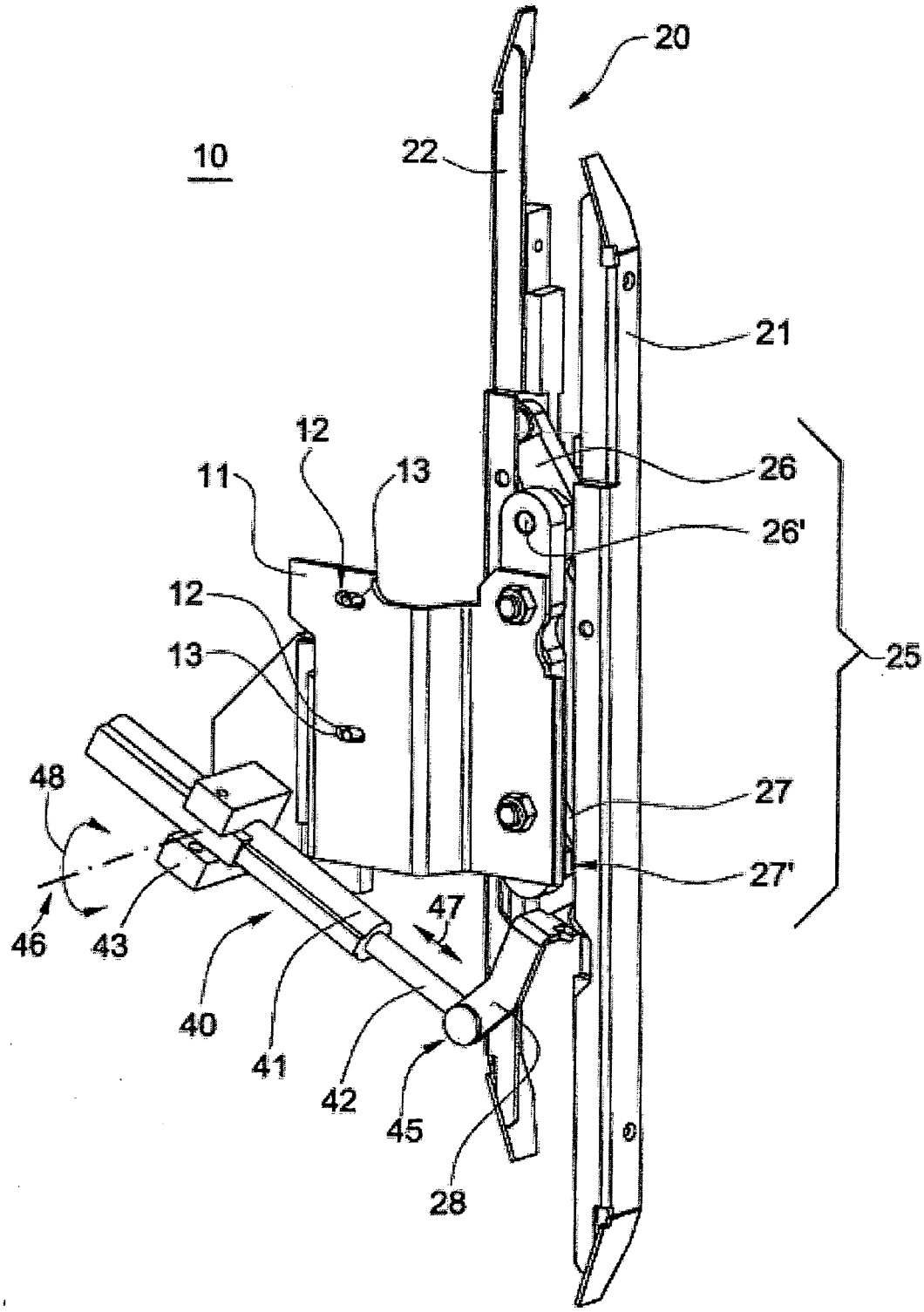
FIG. 1 is a perspective view of a clutch in accordance with the present invention.
Figure 2:
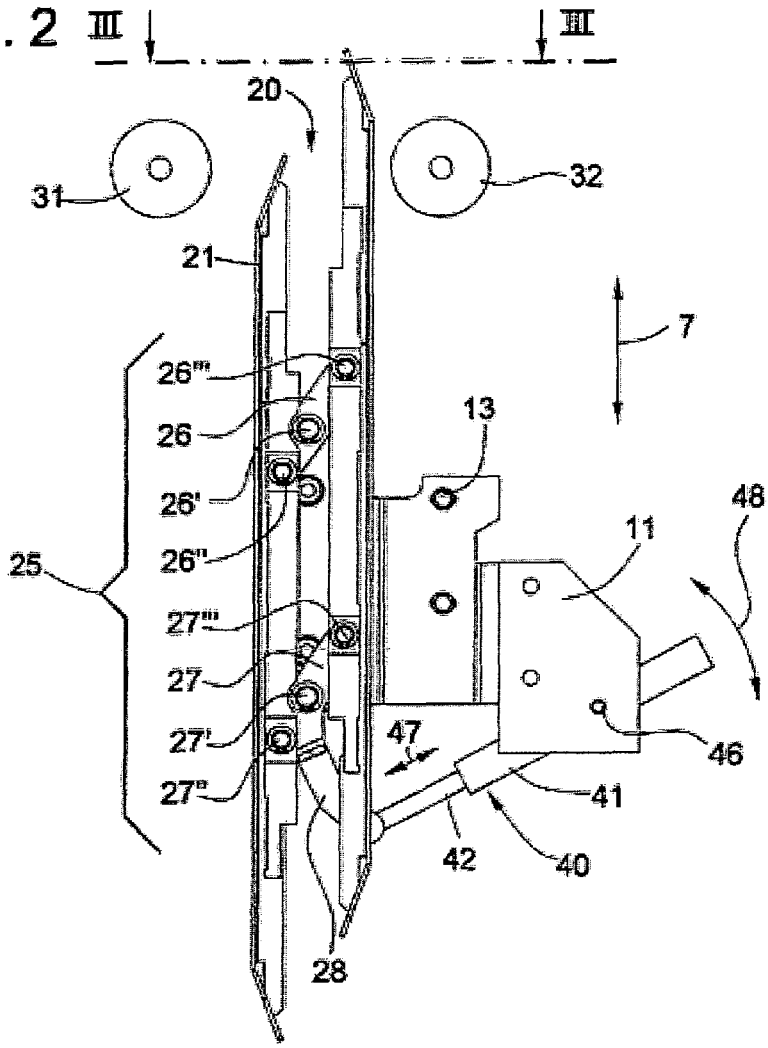
FIG. 2 is an elevation view of the clutch of FIG. 1, the clutch being arranged at a car door and the car being located in a landing zone at a landing door.

Referring to FIGS. 1 and 2, the clutch 10 comprises a support 11. At the support 11, all movable parts of the clutch 10 are arranged which are:

- a coupling element 20 which consists of two vanes 21, 22 being arranged in parallel and a linkage 25 connecting both vanes 21 and 22,
- a linear motor 40 which comprises a motor primary 41 and a motor secondary 42,
- a clamp 43 for connecting the motor primary 41 pivotally about a pivot 46 with the support 11 and
- a lever 28, one end of which is connected with the motor secondary 42 pivotally about pivot 45 and another end being connected with the linkage 25.

The linkage 25 comprises a first connecting element 26 and a second connecting element 27. The first connecting element 26 is connected with the support 11 pivotally about a pivot 26'. In addition, the first connecting element 26 is connected with the vanes 21 and 22 pivotally about pivots 26" and 26'", respectively. The second connecting element 27 is connected with the support 11 pivotally about a pivot 27'. In addition, the second connecting element 27 is connected with the vanes 21 and 22 pivotally about pivots 27" and 27'", respectively.

The linkage 25 is arranged such that the vanes 21 and 22 and the connecting elements 26 and 27 form a parallelogram. The connecting elements 26 and 27 can synchronously rotate about the pivots 26' and 27', respectively, thereby keeping the vanes 21 and 22 in parallel and changing the distance between the vanes 21 and 22.

The lever 28 is rigidly coupled to the connecting element 27.

As indicated in FIGS. 1 and 2, the pivots 26', 26", 26'", 27', 27", 27'", 45 and 46 are arranged in parallel. All pivots may be provided with a wear resistant bearing.

By means of a control unit (not shown), the linear motor 40 can be actuated, thus leading to a linear movement of the motor secondary 42 with respect to the motor primary 41, as indicated by an arrow 47 in FIG. 2. Since the motor secondary 42 is connected with the lever 28 at the first pivot 45, the connecting elements 26 and 27 can be turned around the pivots 26' and 27', respectively, by actuating the linear motor 40. In addition, since the motor primary 41 is pivotally connected with the support 11, the motor primary 41 is turned around the pivot 46 upon an actuation of the linear motor 40, as indicated by an arrow 48 in FIG. 2.

The support 11 is provided with holes 12. Fastening means 13 may be passed through these holes in order to fix the clutch 20 at a car door.

Figure 3:
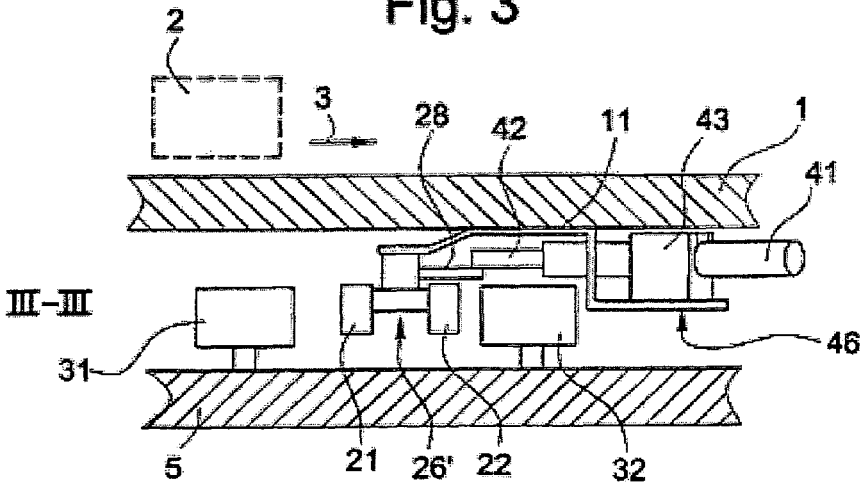
FIG. 3 is a plan view of the clutch of FIG. 2 taken on the line III-III.

Referring now to FIG. 3, the clutch 10 is fixed at a car door 1 of an elevator car. The clutch 10 is arranged such that the vanes 21 and 22 are aligned parallel to the direction in which the elevator car can be moved during operation of the elevator. Said direction of motion of the elevator car is indicated by an arrow 7 in FIGS. 2, 4 and 5. The car door 1 is arranged essentially parallel to the direction of motion of the car, too.

For causing the car door 1 to open or close, an actuator 2 is provided (as schematically represented in FIG. 3). An arrow 3 in FIG. 3 indicates the opening direction.

In the situation shown in FIGS. 2 and 3, the elevator car is arriving in a landing zone at a landing door 5, which is arranged essentially parallel to the direction of motion of the car. Both the car door 1 and the landing door are closed.

Figure 4:
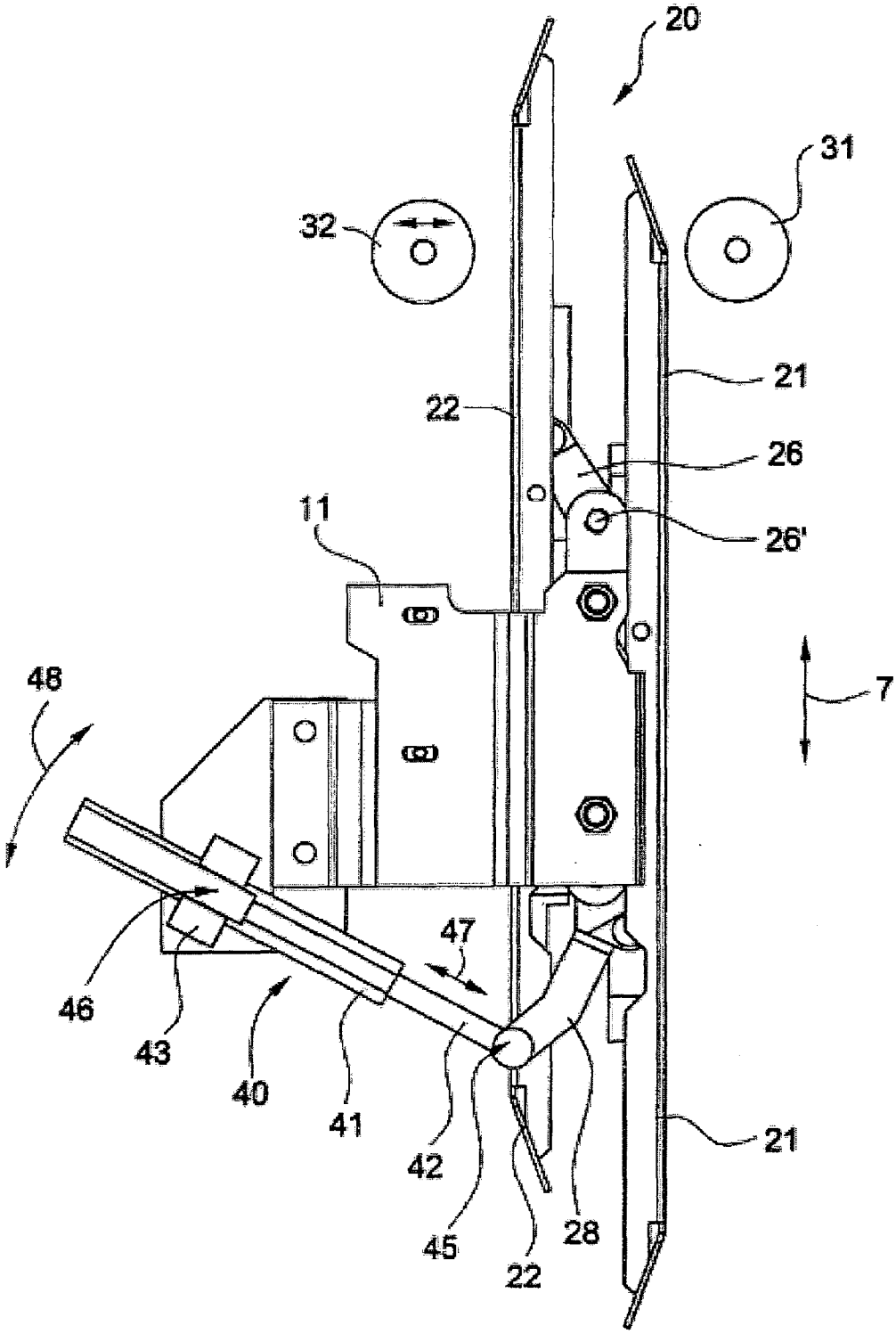
FIG. 4 is an elevation view of the clutch of FIG. 2, from the opposite direction, the clutch not being engaged with the landing door.

For enabling the car door 1 to be coupled with the landing door 5, the landing door 5 comprises two rollers 31 and 32 facing the car door 1. The rollers 31 and 32 are arranged at a distance with respect to each other. The coupling element 20 has been passed between the rollers 31 and 32 upon arrival of the elevator car in the landing zone. The distance between the rollers 31 and 32 is chosen such that both of the following conditions are fulfilled:

By actuating the linear motor 40, the coupling element 20 can be moved with respect to the car door 1 to a first position, such that the vanes 21 and 22 do not touch the rollers 31 and 32 (FIGS. 2, 3 and 4). Under these circumstances, the coupling element 20 is not engaged with the landing door 5. Thus, the car door 1 is not coupled with the landing door 5.

Figure 5:
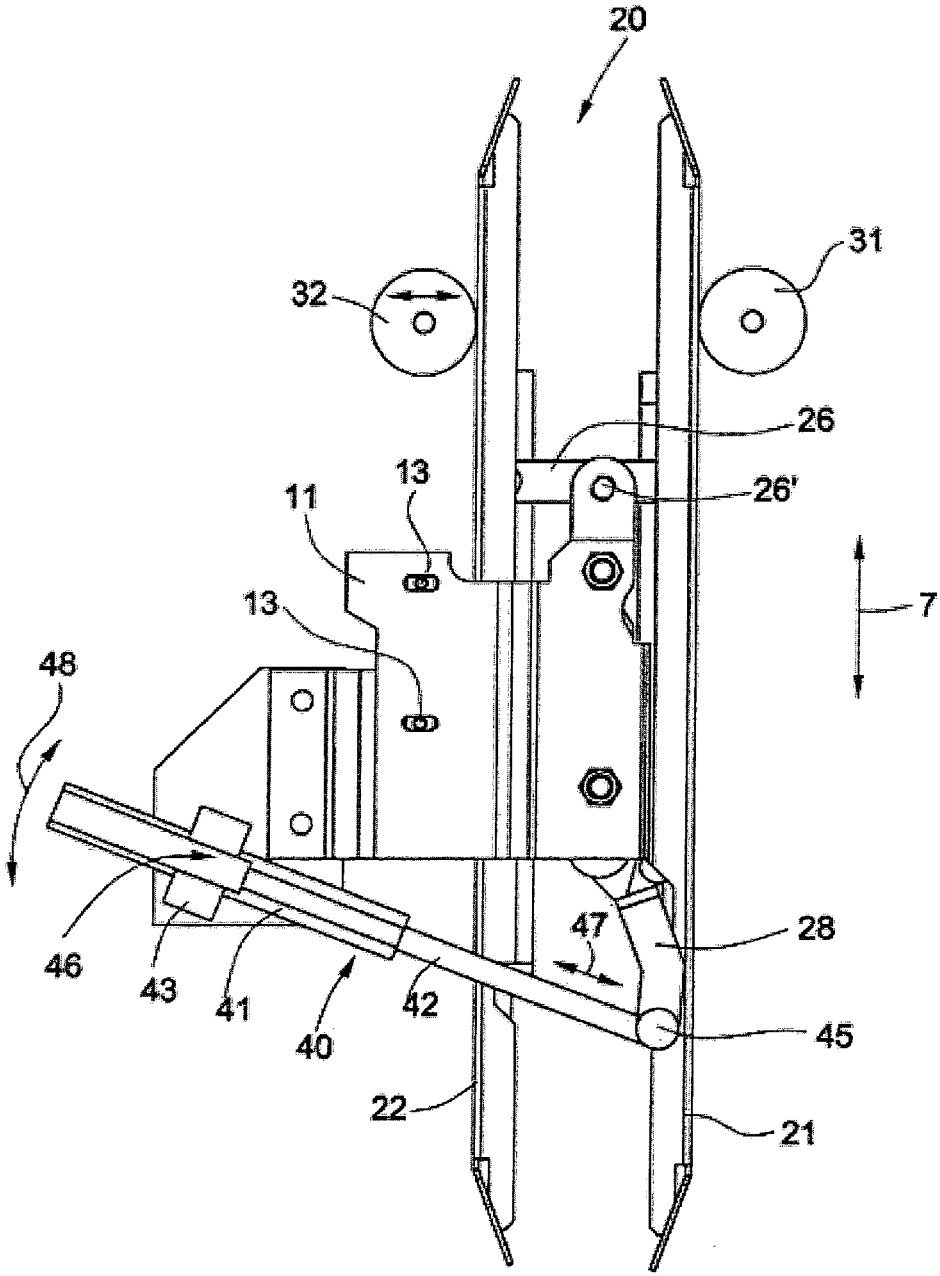
FIG. 5 is a view of the clutch shown in FIG. 4 with the clutch being engaged with the landing door.

By actuating the linear motor 40, the coupling element 20 can be moved with respect to the car door 1 to a second position, such that the vanes 21 and 22 touch the rollers 31 and 32 (FIG. 5). Under these circumstances, the coupling element 20 is engaged with the landing door 5. Thus, the car door 1 is coupled with the landing door 5.

Thus, by actuating the linear motor 40, the car door 1 can be caused to couple or to uncouple with the landing door 5.

FIGS. 4 and 5 show the clutch 20 for two different situations. According to FIG. 4, the motor secondary 42 is arranged with respect to the motor primary 41 such that the coupling element 20 does not touch the rollers 31 and 32. Thus, a coupling of the car door 1 with the landing door 5 is not established. By moving the motor secondary 42 towards the coupling element 20 and, thereby, turning the motor primary 41 around the pivot 46, the vanes 21 and 22 are moved within a plane parallel to the direction 7 of motion of the elevator car and the distance between the vanes 21 and 22 increases, thus causing the coupling element 20 to touch the rollers (FIG. 5). In the latter case, a coupling of the car door 1 with the landing door 5 is established.

The roller 32 may be provided with an axis of rotation which can be shifted within certain limits in the horizontal direction as indicated by an arrow in FIGS. 4 and 5, thus causing the distance between the rollers 31 and 32 to change. In this case, a lateral shift of the roller 32 can be achieved by means of the linear motor 20, when a coupling of the car door 1 with the landing door 5 is established. This shift can be used for controlling a mechanism for locking and/or unlocking the landing door 5. Similarly, a mechanism for locking and/or unlocking the car door 1 can be coupled to the clutch, the mechanism being actuated by the linear motor 40.

If a coupling of the car door 1 with the landing door 5 is established, the landing door can be opened or closed by means of the actuator 2.

The linear motor 40 is a tubular linear motor. The motor primary 41 comprises windings for providing a traveling magnetic field. The motor secondary 42 is a tube in which are disposed permanents magnets of circular section, for example made of Neodymium-Iron-Boron magnetic material. Such a tubular linear motor is a simple, low cost, low noise and highly reliable device to drive the clutch. Its motion and force can be precisely controlled, in contrast for example to a simple solenoid which would lack those features.

Of course, linear motors of another kind are appropriate for actuating the clutch.

The clutch 10 may be modified within the scope of the invention. Instead of connecting the linear motor 40 with the linkage 25, the linear motor 40 may be connected with one of the vanes 21 or 22. Furthermore, the motor secondary 42 may be pivotally connected with the support 11 and the motor primary 41 may be connected with the coupling element 20.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A clutch for coupling a car door of an elevator car with a landing door of an elevator system, wherein the car door is movable with respect to the elevator car by means of a first actuator, comprising:

at least one coupling element mounted on the car door; and a second actuator for moving said coupling element with respect to the car door between a first position and a second position such that said coupling element engages with the landing door when the elevator car is within a landing zone, and for moving said coupling element towards the second position thereby establishing coupling of the car door with the landing door, said second actuator being a linear motor having a motor primary providing a traveling magnetic field for controlling motion and force generated by said linear motor.

2. The clutch according to claim 1 wherein said linear motor includes said motor primary and a motor secondary, said motor primary being arranged at the car door and said motor secondary being mounted for force transmission to said coupling element.

3. The clutch according to claim 1 wherein said linear motor includes said motor primary and a motor secondary, said motor secondary being arranged at the car door and said motor primary being mourned for force transmission to said coupling element.

4. The clutch according to claim 1 wherein said coupling element includes two vanes connected by a movable linkage such that said vanes are movable with respect to each other for establishing a mechanical contact of said vanes with the landing door.

5. The clutch according to claim 2 wherein said motor secondary is linked to said coupling element by a first pivot and said motor primary is rotatable about a second pivot being stationary with respect to the car door.

6. The clutch according to claim 5 wherein said coupling element includes two vanes connected by a movable linkage such that said vanes are movable with respect to each other for establishing a mechanical contact of said vanes with the landing door and wherein said first pivot is arranged at said linkage or one of said vanes.

7. The clutch according to claim 3 wherein said motor primary is linked to said coupling element by a first pivot and said motor secondary is rotatable about a second pivot being stationary with respect to the car door.

8. The clutch according to claim 7 wherein said coupling element includes two vanes connected by a movable linkage such that said vanes are movable with respect to each other for establishing a mechanical contact of said vanes with the landing door and wherein said first pivot is arranged at said linkage or one of said vanes.

9. A clutch for coupling a car door of an elevator car with a landing door of an elevator system, wherein the car door is movable with respect to the elevator car by means of an actuator, comprising:

at least one coupling element;

a linear motor for moving said coupling element with respect to the car door between a first position and a second position such that said coupling element engages with the landing door when the elevator car is within a landing zone, and for moving said coupling element towards the second position thereby establishing coupling of the car door with the landing door; and said linear motor including a motor primary and a motor secondary, said motor primary being arranged at the car door and said motor secondary being mounted for force transmission to said coupling element, said motor secondary being linked to said coupling element by a first pivot and said motor primary being rotatable about a second pivot being stationary with respect to the car door and said motor primary providing a traveling magnetic field for controlling motion and force generated by said linear motor.

10. The clutch according to claim 9 wherein said coupling element includes two vanes connected by a movable linkage such that said vanes are movable with respect to each other for establishing a mechanical contact of said vanes with the landing door and wherein said first pivot is arranged at said linkage.

* * * * *